US005701745A

United States Patent [19]

Cheng et al.

[11] Patent Number: 5,701,745

[45] Date of Patent: Dec. 30, 1997

[54] CRYOGENIC COLD SHELF

[75] Inventors: Alan Tat Yan Cheng, Livingston, N.J.; Donald Leonard DeVack, Norwalk, Conn.

[73] Assignee: Praxair Technology, Inc., Danbury, Conn.

[21] Appl. No.: 768,061

[22] Filed: Dec. 16, 1996

[51] Int. Cl.[6] ..... F25B 19/00; F17C 7/02

[52] U.S. Cl. ..... 62/51.1; 62/52.1; 165/908; 34/239

[58] Field of Search ..... 62/51.1, 52.1, 62/515; 34/92, 239

[56] References Cited

U.S. PATENT DOCUMENTS

| | | | |
|---|---|---|---|
| 3,352,123 | 11/1967 | Ulbricht et al. | 62/52.1 |
| 3,446,028 | 5/1969 | Wulf | 62/52.1 |
| 3,464,222 | 9/1969 | Gramse | 62/52.1 |
| 3,525,235 | 8/1970 | Maurer | 62/52.1 X |
| 4,667,478 | 5/1987 | Jones, III | 62/52.1 X |
| 4,991,402 | 2/1991 | Saia, III | 62/239 X |
| 5,456,084 | 10/1995 | Lee | 62/51.1 |
| 5,519,946 | 5/1996 | Renzi | 34/239 |

FOREIGN PATENT DOCUMENTS

| | | | |
|---|---|---|---|
| 8074103 | 5/1983 | Japan | 34/297 |
| 2120370 | 11/1983 | United Kingdom | 34/297 |

*Primary Examiner*—Christopher Kilner
*Attorney, Agent, or Firm*—Stanley Ktorides

[57] ABSTRACT

A cryogenic cold shelf for use in a freeze drying system having a cryogen distributor for passing cryogenic fluid into the shelf volume of the cold shelf at differing rates so as to even refrigeration provided over the entire shelf resulting in a uniform temperature over the cold shelf.

10 Claims, 2 Drawing Sheets

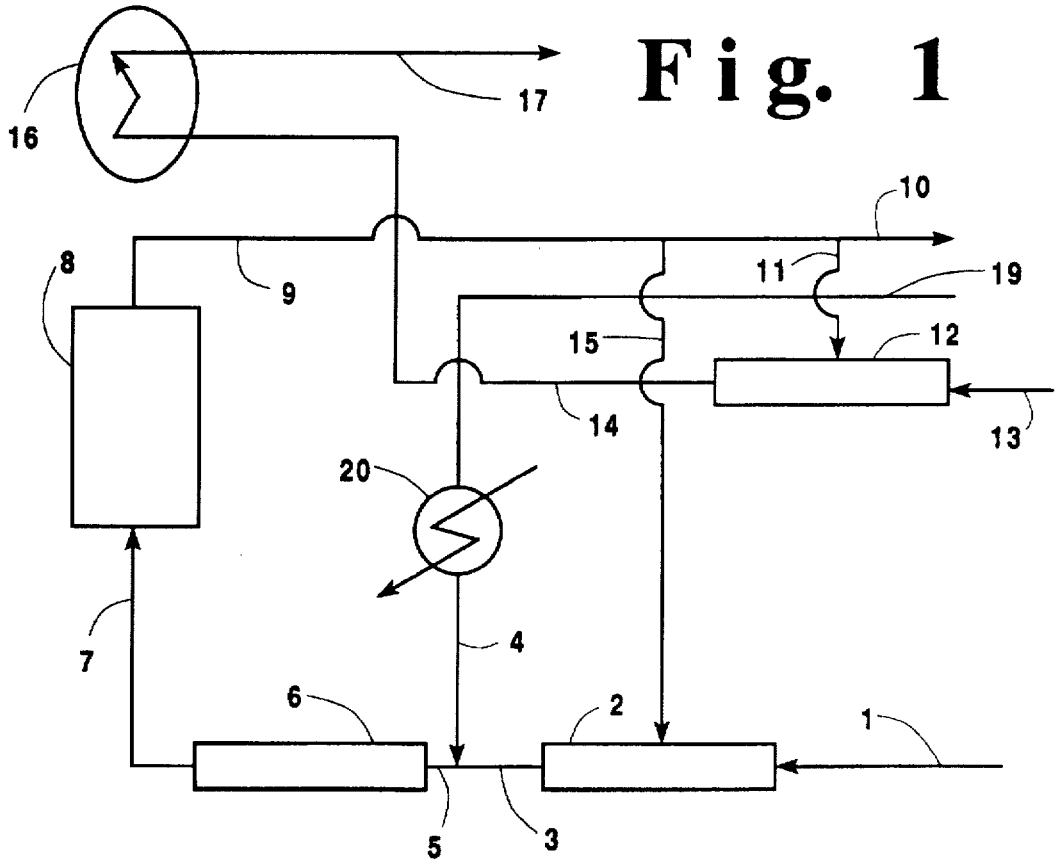
Fig. 1
Fig. 2
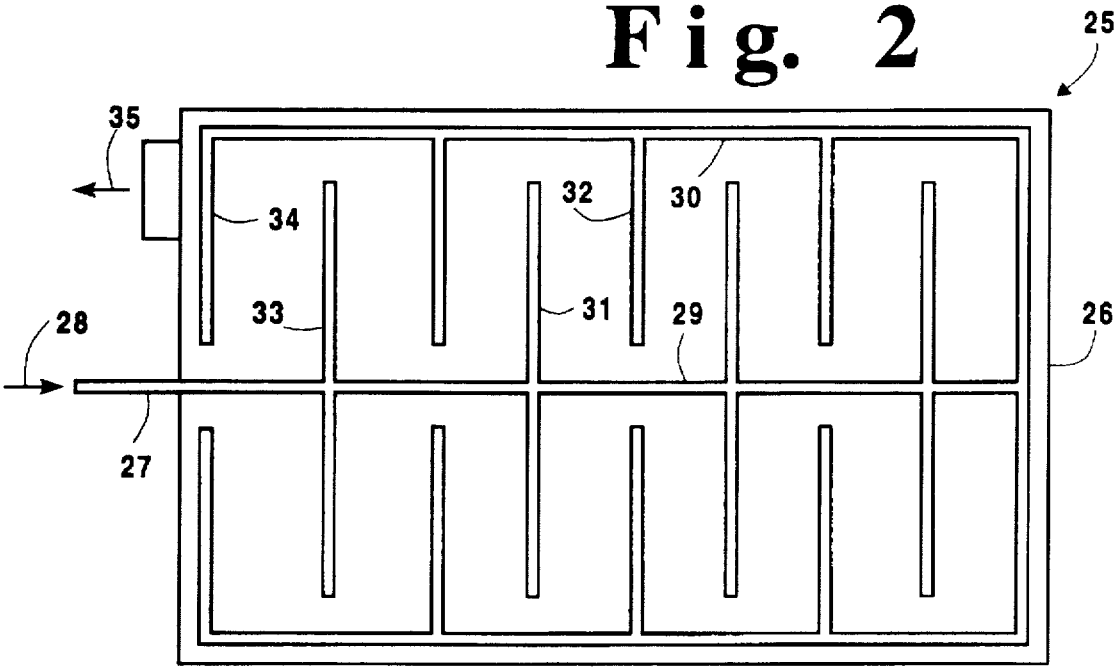

CRYOGENIC COLD SHELF

TECHNICAL FIELD

This invention relates generally to freeze drying and, more particularly, to cold shelves employed to carry out freeze drying.

BACKGROUND ART

Freeze drying is a sublimation process that removes free water in the form of ice. Freeze drying is especially useful in the pharmaceutical industry to remove water from biological products because it preserves the integrity of the biological products. In freeze drying the water-containing product is frozen and, under vacuum with the partial pressure of water vapor reduced below the triple point of water, the frozen water sublimes and the sublimated ice is removed from the dryer.

It is important that the water-containing product be completely frozen prior to the drying steps. Moreover, because the water-containing product generally includes another solvent and/or soluble solids, the freezing point of the product, termed the lowest eutectic temperature, is generally much lower than the freezing point of water. For example, the lowest eutectic temperature of a sugar based biological product may be as low as −65° C. Accordingly, freeze drying requires the provision of significant refrigeration over a short period of time.

Heretofore, freeze drying has been carried out commercially using mechanical freezing systems. However, the refrigerant, such as for example a Freon, which is generally used with such mechanical devices has been deemed environmentally deleterious and is being eliminated from commercial use. Replacement refrigerants are not as thermodynamically effective making their use in the demanding application of freeze drying problematic. Moreover, replacement refrigerants for mechanical chillers are generally corrosive and toxic and require different compression ratios, making their use expensive from an operational standpoint. Moreover, an additional intermediate heat transfer fluid is needed and this has severe limitations on the temperature ranges that can be achieved.

It is known that a cryogenic fluid such as liquid or gaseous nitrogen is very cold and can deliver a significant quantity of refrigeration. However, cryogenic fluids have not heretofore been used to refrigerate the cold shelves of a freeze dryer. The cold shelf is the platform upon which the water-containing product is placed for freeze drying. It is important in carrying out freeze drying that the temperature be uniform over the entire cold shelf to ensure product quality. It is very difficult to control the release of refrigeration from a cryogenic fluid. It has heretofore been impractical to provide a near uniform temperature distribution across the entire cold shelf of a freeze dryer using a cryogenic fluid.

Accordingly, it is an object of this invention to provide a cold shelf for use in a freeze drying system wherein a cryogenic fluid may be used as the source of refrigeration and wherein a relatively uniform cold temperature may be provided over the entire cold shelf.

It is another object of this invention to provide a cold shelf for use in a freeze drying system wherein a cryogenic fluid may be used as the source of refrigeration thus eliminating the need for an intermediate heat transfer fluid and the concomitant limitations on the temperature ranges.

SUMMARY OF THE INVENTION

The above and other objects, which will become apparent to one skilled in the art upon a reading of this disclosure, are attained by the present invention, one aspect of which is:

A cryogenic cold shelf comprising spaced panels defining a shelf volume, and a cryogen distributor within said shelf volume in flow communication with a source of cryogenic fluid and capable of having cryogenic fluid flow therethrough, said cryogen distributor comprising a main flow path having a first leg and a second leg downstream of the first leg, said first leg having a plurality of first branches extending from the first leg, and said second leg having a plurality of second branches extending from said second leg and oriented between said first branches.

Another aspect of the invention is:

A cryogenic cold shelf comprising spaced panels defining a shelf volume, and a cryogen distributor within said shelf volume in flow communication with a source of cryogenic fluid and capable of having cryogenic fluid flow therethrough, said cryogen distributor comprising a main flow path having a cryogenic fluid input and having a length extending through the shelf volume, and having a plurality of branches communicating with the main flow path along its length, said branches having perforations for passing cryogenic fluid out from the cryogen distributor into the shelf volume, at least one branch positioned closer to the cryogenic fluid input having smaller perforations than at least one branch positioned further from the cryogenic fluid input.

As used herein, the term "cryogenic fluid" means a fluid having a temperature at or below −80° C.

BRIEF DESCRIPTION OF THE DRAWINGS

FIG. 1 is a simplified schematic representation of one arrangement for providing cryogenic fluid for freeze drying which may be used in the practice of this invention.

FIG. 2 is a simplified plan view of one embodiment of the cryogenic cold shelf of this invention with the upper panel removed.

DETAILED DESCRIPTION

Figure 3:
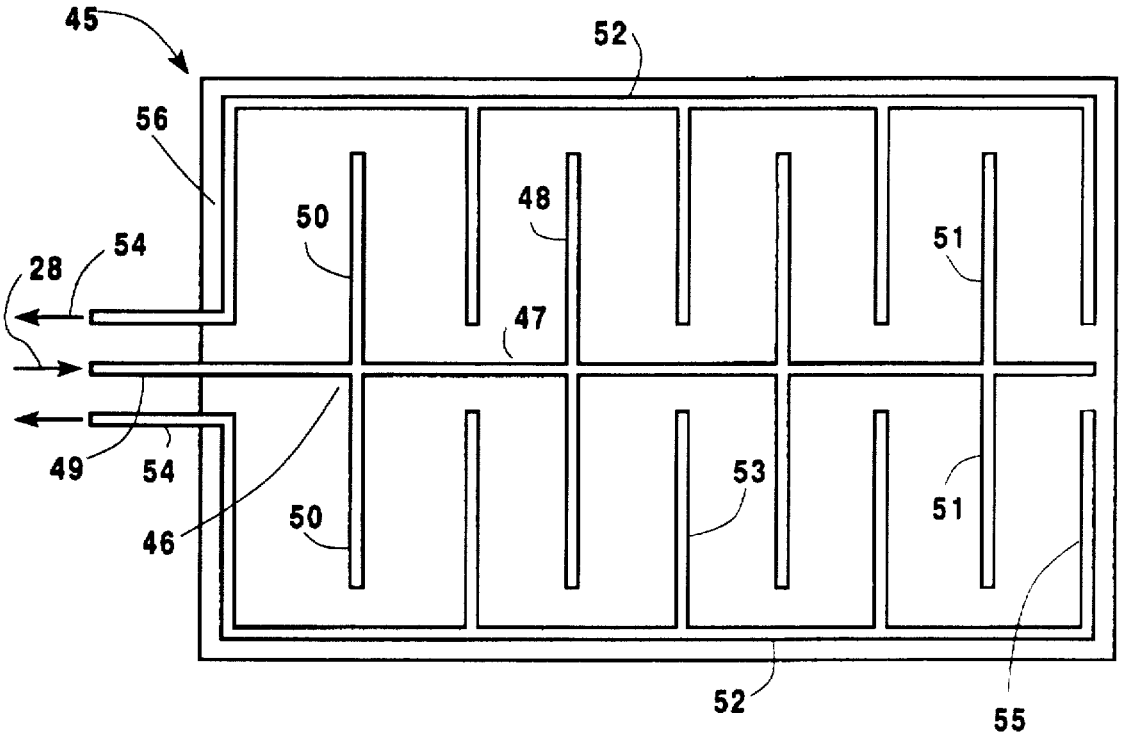
FIG. 3 is a simplified plan view of another embodiment of the cryogenic cold shelf of this invention with the upper panel removed.

The invention will be described in detail with reference to the Drawings and with the use of vaporized liquid nitrogen as the cryogenic fluid. Any effective cryogenic fluid may be used in the practice of this invention. The cryogenic fluid may be in the form of a liquid, a gas or a gas/liquid mixture. Among the components which may be used in the practice of this invention as or in the cryogenic fluid one can name, nitrogen, argon, oxygen, helium and air.

FIG. 1 illustrates in simplified form one overall arrangement for a freeze drying system employing cryogenic fluid. Referring now to FIG. 1, liquid nitrogen is provided in stream 1 into venturi 2. The venturi has a compression cone and an expansion cone. When the pressurized cryogenic fluid passes through, it will entrain low pressure spent nitrogen gas 15 at the center of the venturi. Thus, if desired, part of the spent nitrogen gas 9 can be recycled to mix or vaporize part of the incoming cryogenic fluid 1.

Liquid nitrogen 3 is withdrawn from venturi 2 and is combined with warm nitrogen gas in stream 4 to form stream 5 which is mixed in in-line mixer 6. The mixing action in in-line mixer 6 causes the liquid nitrogen to vaporize and to form cryogenic gas which is passed in line 7 into freeze dryer 8. The freeze dryer has a plurality of vertically oriented cold shelves upon which the water-containing product is placed for freeze drying. After the cryogenic gas is employed in the cold shelves for freeze drying, it is withdrawn from the cold shelves of the freeze dryer as shown by line 9. The spent nitrogen gas is split into three portions. A portion 10 of the spent nitrogen gas in line 9 is withdrawn from the system. Another portion 11 is passed into venturi 12 into which is also passed additional liquid nitrogen in stream 13. Nitrogen fluid is withdrawn from venture 12 in stream 14. Normally condenser 16 is operating at 10° C. colder than are the cold shelves of freeze dryer 8. Stream 14 can be used directly in condenser 16. A third portion 15 of stream 9 is passed into venturi 2 as described earlier and is employed to form the aforesaid stream 3. If needed, nitrogen gas in stream 19 is warmed by passage through heater 20 to form stream 4 which is mixed with stream 3 as was previously described.

During the cooling and freezing cycles very little heat is required from heater 20. A temperature programmer measuring the temperatures in the freeze dryer will provide heat into stream 19. When the water-containing product is fully frozen and the vacuum cycle has started, the temperature programmer will gradually increase heat load to heater 20. A second temperature program may gradually increase the temperature of cryogenic fluid 1 or mix in room temperature nitrogen gas. At the end of the cycle stream 7 can reach as high as 60° C. while stream 1 may be supplying room temperature nitrogen gas. Cryogenic fluid 13 maintains the cold temperature until the stoppers have closed the water-containing products.

FIG. 2 illustrates in plan view a cryogenic cold shelf of this invention as may be used in a freeze dryer such as freeze dryer 8 illustrated in FIG. 1. Referring now to FIG. 2, cold shelf 25 comprises spaced panels which define a shelf volume therebetween. In the representation of FIG. 2, the upper panel of cold shelf 25 is not shown in order to illustrate the cryogen distributor. The lower panel of cold shelf 25 is illustrated as panel 26.

Within the shelf volume of cold shelf 25 there is positioned cryogen distributor 27 which is in flow communication with a source of cryogenic fluid 28, e.g. line 7 of the system illustrated in FIG. 1. Cryogenic distributor 27 is capable of having cryogenic fluid flow therethrough. Typically cryogen distributor 27 comprises tubing having an inside diameter within the range of 0.125 to 3 inches.

Cryogen distributor 27 comprises a main flow path and branching flow paths. The main flow path comprises a first portion or first leg 29 and a second portion or second leg 30 downstream of the first leg. First leg 29 has a plurality of first branches 31 extending from the first leg preferably at a 90° angle, and second leg 30 has a plurality of second branches 32 extending from the second leg preferably at a 90° angle. At least one of the second branches 32 is oriented between first branches 31. The first branches 31 extending from first leg 29 receive slightly more cryogenic fluid than the second branches 32 extending from downstream second leg 30 due to pressure drop through the main flow path of cryogen distributor 27. In this manner, for example, the branch 33 which, in flow terms, is closest to the cryogenic fluid input 28 and has the highest cryogenic fluid flow rate therethrough, is matched up with branch 34 which, in flow terms, is farthest from input 28 and thus has the least cryogenic fluid flowing therethrough. As a result, a uniform distribution of cryogenic fluid is achieved throughout the cold shelf volume.

The first and second branches are perforated, the perforations having a diameter generally within the range of from 1/64 to 1/4 inch. The cryogenic fluid passes out from the perforations of the first and second branches and into the cold shelf volume wherein it serves to pass refrigeration into the upper and lower panels and from there to the water-containing products for freeze drying. Because of the uniform distribution of the cryogenic fluid through the cold shelf volume, the temperature is uniform over the entire area of the cold shelf. Spent cryogenic fluid is withdrawn from the cold shelf volume through exit conduit 35 which, for example, corresponds to line 9 of the arrangement illustrated in FIG. 1.

In the embodiment of the invention illustrated in FIG. 2 the first leg of the main flow path is positioned in the central area of the cold shelf volume and the second leg of the main flow path is positioned in a peripheral area of the cold shelf volume. Those skilled in the art will appreciate that other arrangements will also be effective. For example, the first leg could be positioned in one peripheral area with the second leg positioned in another peripheral area. In another arrangement both the first leg and the second leg could be positioned in the central area of the cold shelf volume.

FIG. 3 illustrates another embodiment of the invention. The cold shelf 45 illustrated in FIG. 3 is in some ways similar to that illustrated in FIG. 2 and these common features, i.e. the upper and lower panels, the shelf volume, the tubing size, and the communication with a source of cryogenic fluid, will not be described again in detail.

Referring now to FIG. 3, cryogen distributor 46 comprises main flow path 47 and branches 48 extending out along the length of the main flow path. Preferably main flow path 47 extends through substantially the entire length of the cold shelf volume. At one end of the main flow path there is cryogenic fluid input 49 for receiving cryogenic fluid into the cryogen distributor. The branches positioned closer to cryogenic fluid input 49, e.g. branches 50, have perforations which are smaller than the perforations which are in the branches, e.g. branches 51, which are further from cryogenic fluid input 49. In this way cryogenic fluid flows into the shelf volume through the branches further from input 49 at about the same flow rate as does cryogenic fluid flowing into the shelf volume through the branches closer to input 49 despite the pressure drop experienced along the length of main flow path 47. Typically the perforations in the further branches such as branches 51 will have an average diameter within the range of from 1/48 to 1/4 inch and the perforations in the closer branches such as branches 50 will have an average diameter within the range of from 1/64 to 1/5 inch. In this way the refrigeration provided to the cold shelf by the cryogenic fluid is evenly distributed over the entire surface of the cold shelf thus achieving similar benefits as with the embodiment of the invention illustrated in FIG. 2.

Spent cryogenic fluid may be withdrawn from the shelf volume of cold shelf 45 in the same manner as was illustrated in connection with shelf 25. FIG. 3 illustrates a preferred system for withdrawing spent cryogenic fluid from the shelf volume wherein the spent fluid is uniformly withdrawn from the shelf volume thus further avoiding the creation of any temperature gradient over the area of the cold shelf. Referring back now to FIG. 3, withdrawal line 52 has a length extending through cold shelf 45 with a plurality of branches 53 extending outward along its length and a fluid exhaust 54 at one end of its length. The branches further from exhaust 54, e.g. branch 55, have larger perforations similar to those of branches 51, than do the branches closer to exhaust 54, e.g. branch 56, which have perforations similar to those of branches 50. The spent fluid withdrawn through exhaust 54 may then be passed out of the freeze dryer such as is indicated by line 9 in FIG. 1.

Figure 4:
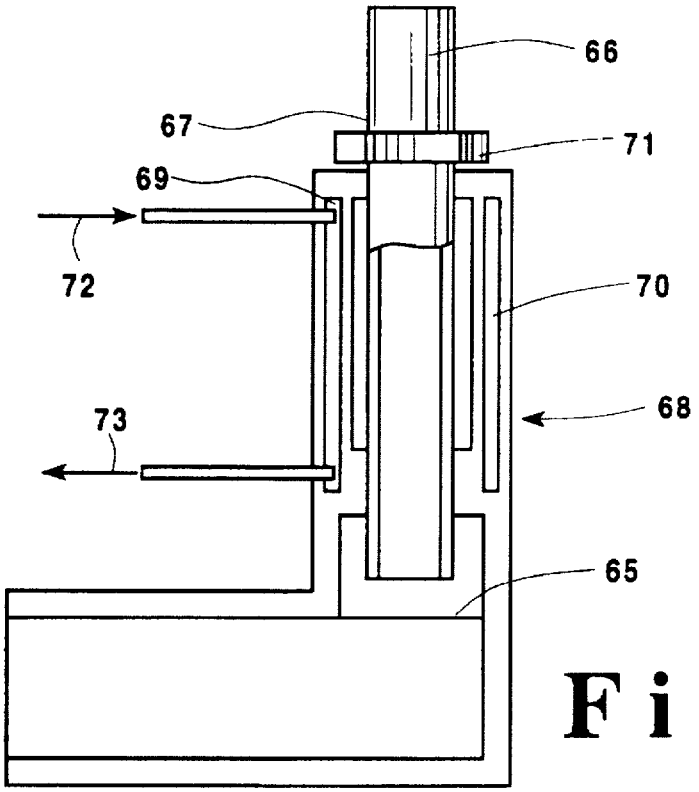
FIG. 4 is a cross-sectional representation of a preferred joint which enables easier vertical movement of the cryogenic cold shelf of this invention.

In freeze drying it may be desirable to move the vertically stacked cryogenic cold shelves up or down in order to stopper or otherwise process flasks or other containers containing the product. The cold shelves may be pressed together without damaging the cryogenic fluid piping using the joint illustrated in FIG. 4. Referring now to FIG. 4, cryogenic fluid is provided to the cryogen distributor by means of Cryogenic transfer pipe 65 and cryogenic tube 66 which is movable therein. Cryogenic tube 66 has vacuum insulation 67 along its length and, at the interconnection of cryogenic tube 66 with cryogenic transfer pipe 65 there is joint 68 which comprises packing gland 69 made of fluorocarbon, graphite or other low temperature packing materials, and gas heating gland 70, both held in place by packing nut 71. The packing gland keeps the cryogenic fluid from leaking and entering the vacuum chamber of the freeze dryer. A warm gas is circulated inside gas heating gland 70 as shown by gas input 72 and gas output 73 to keep the packing material above its glass transition or embrittlement temperatures. The length of the packing gland and of the gas heating gland will depend upon the vertical traveling distance of the cryogenic cold shelves. The joint illustrated in FIG. 4 will enable the cryogenic cold shelf of this invention to easily move vertically with the rigid cryogenic transfer pipe attached, thus further enhancing the utility of the invention. If no shelf movement is required prior to the shelf being warmed to room temperatures, the joint illustrated in FIG. 4 is not necessary and flexible cryogenic hose for the connection is sufficient.

Although the invention has been described in detail with reference to certain preferred embodiments, those skilled in the art will recognize that there are other embodiments of the invention within the spirit and the scope of the claims.

We claim:

1. A cryogenic cold shelf comprising spaced panels defining a shelf volume, and a cryogen distributor within said shelf volume in flow communication with a source of cryogenic fluid and capable of having cryogenic fluid flow therethrough, said cryogen distributor comprising a main flow path having a first leg and a second leg downstream of the first leg, said first leg having a plurality of first branches extending from the first leg, and said second leg having a plurality of second branches extending from said second leg and oriented between said first branches.

2. The cryogenic cold shelf of claim 1 wherein the first leg is positioned in a central area of the shelf volume and the second leg is positioned in a peripheral area of the shelf volume.

3. The cryogenic cold shelf of claim 1 further comprising means for withdrawing cryogenic fluid from the shelf volume, said withdrawal means comprising a withdrawal line having a length and an exhaust and having a plurality of withdrawal branches along its length, at least one withdrawal branch further from the exhaust having perforations which are larger than perforations on at least one withdrawal branch which is closer to the exhaust.

4. The cryogenic cold shelf of claim 1 further comprising a joint for connecting the cryogen distributor to the source of cryogenic fluid, said joint comprising a packing gland and a gas heating gland around the packing gland, said gas heating gland having a means for receiving warm gas and a means for exhausting warm gas, said packing gland surrounding piping of the cryogen distributor which is capable of movement relative to said packing gland.

5. The cryogenic cold shelf of claim 1 wherein the source of cryogenic fluid is a source of nitrogen.

6. A cryogenic cold shelf comprising spaced panels defining a shelf volume, and a cryogen distributor within said shelf volume in flow communication with a source of cryogenic fluid and capable of having cryogenic fluid flow therethrough, said cryogen distributor comprising a main flow path having a cryogenic fluid input and having a length extending through the shelf volume, and having a plurality of branches communicating with the main flow path along its length, said branches having perforations for passing cryogenic fluid out from the cryogen distributor into the shelf volume, at least one branch positioned closer to the cryogenic fluid input having smaller perforations than at least one branch positioned further from the cryogenic fluid input.

7. The cryogenic cold shelf of claim 6 wherein the main flow path is positioned in a central area of the shelf volume.

8. The cryogenic cold shelf of claim 6 further comprising means for withdrawing cryogenic fluid from the shelf volume, said withdrawal means comprising a withdrawal line having a length and an exhaust and having a plurality of withdrawal branches along its length, at least on withdrawal branch further from the exhaust having perforations which are larger than perforations on at least one withdrawal branch which is closer to the exhaust.

9. The cryogenic cold shelf of claim 6 further comprising a joint for connecting the cryogen distributor to the source of cryogenic fluid, said joint comprising a packing gland and a gas heating gland around the packing gland, said gas heating gland having a means for receiving warm gas and a means for exhausting warm gas, said packing gland surrounding piping of the cryogen distributor which is capable of movement relative to said packing gland.

10. The cryogenic cold shelf of claim 6 wherein the source of cryogenic fluid is a source of nitrogen.

* * * * *